US005127445A

United States Patent [19]

Kakehashi

[11] Patent Number: 5,127,445

[45] Date of Patent: Jul. 7, 1992

[54] AUTOMATIC GAITING ARRANGEMENT FOR A FLUID JET LOOM

[75] Inventor: Norio Kakehashi, Tokyo, Japan

[73] Assignee: Nissan Motor Co., Ltd., Yokohama, Japan

[21] Appl. No.: 592,932

[22] Filed: Oct. 4, 1990

[51] Int. Cl.[5] ..... D03D 47/30

[52] U.S. Cl. ..... 139/452; 139/1 R; 139/435.1

[58] Field of Search ..... 139/452, 435.1, 435.5, 139/1 R

[56] References Cited

U.S. PATENT DOCUMENTS

| | | | |
|---|---|---|---|
| 4,245,677 | 1/1981 | Suzuki | 139/435.1 |
| 4,827,990 | 5/1989 | Takegawa | 139/452 X |
| 4,953,596 | 9/1990 | Takegawa | 139/435.1 |
| 4,967,806 | 11/1990 | Imamura et al. | 139/435.1 |

FOREIGN PATENT DOCUMENTS 58-113791 8/1983 Japan .

*Primary Examiner*—Andrew M. Falik

*Attorney, Agent, or Firm*—Foley & Lardner

[57] ABSTRACT

An air jet loom provided with a main nozzle, a plurality of auxiliary nozzles, and a weft measuring and storing device including a measuring pawl disengagable from a weft yarn to allow the weft yarn to be inserted. During a gaiting operation, a timing (in a loom main shaft rotational angle) of operation of the main nozzle, each auxiliary nozzle and the measuring pawl is controlled in timed relation to a slow rotational speed of the loom main shaft and in a different manner from that during a normal weaving operation, thereby automatically achieving a stable and accurate weft picking even during the gaiting operation.

20 Claims, 3 Drawing Sheets

AUTOMATIC GAITING ARRANGEMENT FOR A FLUID JET LOOM

BACKGROUND OF THE INVENTION

1. Field of the Invention

This invention relates to improvements in a fluid jet loom, and more particularly to an arrangement for automatically and effectively accomplishing a gaiting operation of the fluid jet loom without any troublesome manual operation.

2. Description of the Prior Art

In connection with an air jet loom, a gaiting operation for forming an initial rough structure of a woven fabric is carried out after a looming operation in which warp yarns on the loom are connected with new warp yarns from a replaced warp beam. The gaiting operation is usually carried out as follows: After the respective new warp yarns are connected automatically or manually with the new yarns, an inching switch button for starting an inching operation is pushed to rotate a loom main shaft in a normal direction, and then is released to stop rotation of the main shaft for example at a loom main shaft rotational angle of 180 degrees. At this timing of 180 degrees in loom main shaft rotational angle, air is ejected from a main nozzle and from some (a part) of auxiliary nozzles (as seen from a time chart of FIG. 2 in the present application). This is because during a normal weaving operation, electromagnetic valves for supplying the main and auxiliary nozzles with pressurized air are opened and closed at predetermined loom main shaft rotational angles; particularly the electromagnetic valves for the auxiliary nozzles are so operated that the auxiliary nozzles successively eject air in accordance with the flying position of the leading end of the picked weft yarn.

Subsequently by continuously pushing a measuring pawl releasing button provided in a weft measuring device, the weft yarn wound on a weft storing drum is released or disengaged from the measuring pawl and drawn from the drum to fly throughout a weft guide channel under the influence of an air jet from the main nozzle and from the some of the auxiliary nozzles, thereby accomplishing a weft picking. At this time, the length of the weft yarn unwound from the drum is visually observed. When the leading end of the picked weft yarn reaches a counter weft insertion side, an operator's finger is released from the measuring pawl releasing button to cause the measuring pawl to be again brought into contact with the weft storing drum to engage with the weft yarn on the drum.

The above gaiting operation is repeated until a predetermined tension is applied to warp yarns so that a weaving opeartion becomes stable. It will be understood that during the looming operation, the warp yarns are in a slackened condition, so that it is impossible to operate the loom. Accordingly, after repetition of the above gaiting operation, a loom starting switch button is pushed to start a normal weaving operation. Such a loom operation technique is disclosed, for example, in Japanese Utility Model Publication No. 58-113791, in which a loom is arranged to make its inching operation when an inching switch button is continued to be pushed under the action of a current supplying command device which is adapted to switch ON and OFF a driving circuit for a motor which drives the loom at predermined time intervals.

However, difficulties have encountered in the above-discussed arrangement as discussed hereinafter. At the weft picking during the gaiting operation, the loom main shaft is stopped at 180 degrees in loom main shaft rotational angle, and therefore air is ejected from only some of the auxiliary nozzles while ejecting air from the main nozzle. In other words, only a part of the auxiliary nozzles eject air, so that the remaining auxiliary nozzles cannot eject air. This makes the weft picking unstable, causing a mispick in which the picked weft yarn cannot reach the counter weft insertion side. Furthermore, disengagement and engagement operations of the measuring pawl to the weft yarn are manually carried out, and confirmation of the length of the picked weft yarn is visually made. Consequently, the length of the picked weft yarn is not uniform and causes an excess and deficiency in length, so that the weft yarn may become entangled with the warp yarns. In this case, the weft picking must be repeated many times after removing the entangled weft yarns, thus degrading an operational efficiency of the loom.

SUMMARY OF THE INVENTION

It is therefore an object of the present invention is to provide an improved fluid jet loom in which a gaiting operation is automatically accomplished without any manual operation by an operator, thereby greatly improving operational efficiency during the gaiting operation.

Another object of the present invention is to provide an improved fluid jet loom in which during a gaiting operation, air ejection nozzles and a measuring pawl are operated in accordance with a slow rotation of a loom main shaft and in a different manner from that during a normal weaving operation.

A fluid jet loom of the present invention is schematically illustrated in FIG. 6 and comprised of at least one fluid ejection nozzle for inserting a weft yarn to accomplish a weft picking when ejecting fluid, such as air. A weft measuring and storing device is provided to store the weft yarn prior to the weft picking. The weft measuring and storing device includes a measuring pawl which is disengageable from the weft yarn to allow the weft yarn to be released to be inserted and engageable with the weft yarn to stop releasing of the weft yarn. A driving device is provided to rotate a loom main shaft at a first speed during a normal weaving operation and at a second speed lower than the first speed upon receiving a first signal. An inching commanding device is provided to generate the first signal to command an inching operation. A detecting device is provided to detect a rotational angle of the loom main shaft and generate a second signal representing the rotational angle when the loom main shaft is rotating at the second speed. Additionally, a control unit is provided to cause the air ejection nozzle to eject fluid for a predetermined time and causing the measuring pawl to disengage from and engage with the weft yarn to allow a predertermined length of the weft yarn to be released, when or after the second signal represents a predtermined loom main shaft rotational angle. Engagement of the measuring pawl with the weft yarn may be controlled in response to a singal from a weft unwiding sensor.

Accordingly, during the inching operation (or gaiting operation), the loom main shaft rotates at a lower speed than that during the normal weaving operation under the action of the signal from the inching commanding device. When the detecting device detects that the rotational angle of the loom main shaft reaches a predtermined value, air is ejected from the air jet nozzle (a main nozzle and/or auxiliary nozzles) while the measuring pawl is operated thereby to allow the predetermined length of the weft yarn to be released to be inserted. At this time, it is possible to control air ejection from the air ejection nozzle and the operation of the measuring pawl in timed relation to the slower rotational speed of the loom main shaft. In other words, during inching operation, the timings ( in the loom main shaft rotational angle) for controlling the air ejection and the measuring pawl operation are changed relative to those during the normal weaving operation, thereby achieving a stable and precise weft picking even during the gaiting (inching) operation.

DETAILED DESCRIPTION OF THE INVENTION

Figure 1:
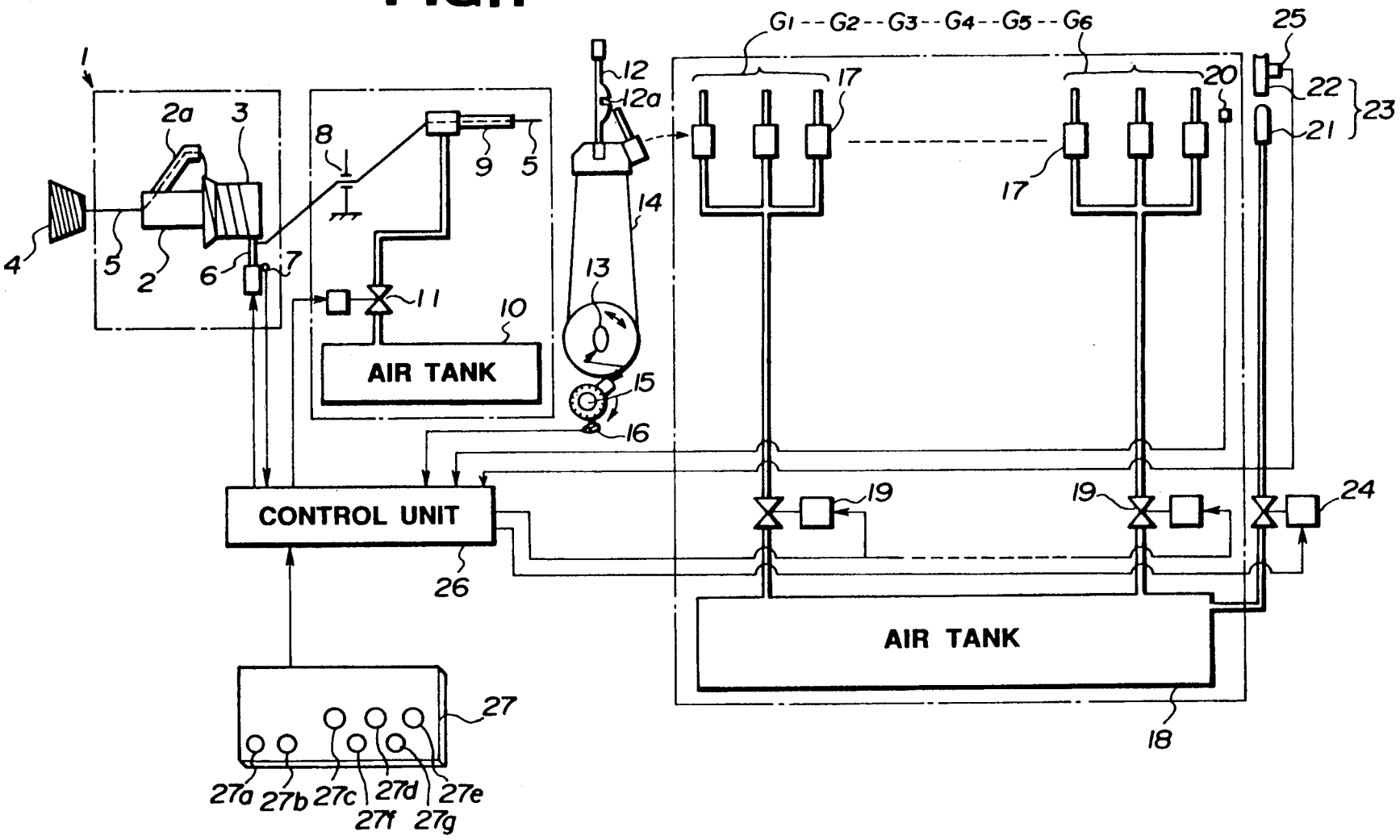
FIG. 1 is a schematic illustration of a fluid jet loom according to the present invention.

Referring now to FIG. 1, a preferred embodiment of an air jet loom according to the present invention is illustrated. The air jet loom comprises a weft picking system including a weft measuring and storing device 1 which includes a rotational weft guide 2 which is driven to rotate by an electric motor (not shown). The weft guide 2 has a guide arm 2*a* through which a weft yarn 5 from a weft supply package 4 passes. A weft storing drum 3 is disposed coaxial with the weft guide 2 and rotatable relative to the weft guide 2 so that the guide arm 2*a* is rotatable around the weft storing drum 3. Accordingly, when the weft guide 2 is rotated, the weft yarn 5 supplied from the weft supply package 4 through the guide arm 2*a* is wound on the weft storing drum 3. The weft storing drum 3 is supported stationarily and has a cylindrical outer peripheral surface. A measuring pawl 6 is movably disposed to be projected to come into contact with the outer peripheral surface of the drum 3 so as to engage with the weft yarn 5 wound on the drum 3, and to be withdrawn to separate from the drum outer peripheral surface so as to disengage with the weft yarn 5. Such projection and withdrawal operations of the measuring pawl 6 is made under the action of a solenoid (no numeral). A weft unwiding sensor 7 is disposed in the vicinity of the measuring pawl 6 and adapted to count the winding number of the weft yarn 5 unwound from the drum 3, outputting signals to a control unit 26. The control unit 26 is adatped to project the measuring pawl 6 to engage with the weft yarn 5 on the drum outer peripheral surface when a predetermined length of the weft yarn is unwound and drawn from the drum 3.

The weft yarn 5 drawn from the weft storing drum 3 is introduced through a yarn guide 8 into a weft inserting or main nozzle 9. The main nozzle 9 is supplied with pressurized air through an electromagnetic valve 11 from a first air tank 10. The electromagnetic valve 11 is adapted to open and close at predetermined timings corresponding to predetermined rotational angles of a loom main shaft 15, in response to signals from the control unit 26. When the electromagnetic valve 11 is opened, pressurizied air is ejected from the tip end of the main nozzle 9 thereby to project the weft yarn 5 introduced into the main nozzle, toward a guide groove 12*a* of each of aligned plural reed blades 12. The aligned guide grooves 12*a* constitute a weft guide channel (not identified) through which the weft yarn 5 projected from the main nozzle flies to be picked.

The reed blades 12 are fixedly mounted on the free end section of a sley sword 14 which is mounted on a sley sword shaft 13 and repciprocally swingable. The sley sword shaft 13 is driven by the loom main shaft 15 through a mechanism (not shown so as to make its reciprocal rotational movement. The loom main shaft 15 is driven by an electric motor which is variable in rotational speed. Examples of the electric motor are a three-phase alternating current motor whose rotational speed is variable under frequency conversion or gear ratio changing, an induction motor, a servo-motor, and a pulse motor. An angle sensor 16 is provided to detect the rotational angle of the loom main shaft 15 and output a signal corresponding to the rotational angle. It will be understood that in FIG. 1, only a moving system including the sley sword 14 is shown as a side view for the sake of simplicity of illustration.

A plurality of auxiliary nozzles 17 are disposed at intervals of a predetermined distance from a weft insertion side (main nozzle side) to a counter weft insertion side along the weft guide channel or along the alighed reed blades 12. As shown in FIG. 1, the auxiliary nozzles 17 are grouped into first to sixth groups $G_1$, $G_2$, $G_3$, $G_4$, $G_5$ and $G_6$ which are aligned along the weft guide channel from the weft insertion side to the counter weft insertion side. Each of the groups includes three auxiliary nozzles 17. The auxilary nozzles 17 are supplied with pressurized air through an electromagnetic valve 19 from a second air tank 18. The electromagnetic valve 19 is adapted to open and close at predetermined timings corresponding to predetermined rotational angles of the main shaft 15, in response to signals from the control unit 26. When the auxiliary nozzle 17 opens, pressurized (auxiliary) air is ejected from the tip end section of the auxiliary nozzle 17 thereby assisting the air stream from the main nozzle 9, thus promoting flying of the weft yarn 5 through the weft guide channel. A feeler 20 is provided on the counter weft insertion side in order to detect the weft yarn 5 reaching the counter weft insertion side. Disposed on an outside of the feeler 20 is a weft traction device 23 including an air ejection nozzle 21 to eject air into a weft suction pipe 22 in which suction is generated. Accordingly, air ejected from the air ejection nozzle 21 is sucked into the suction pipe 22 thereby to apply a tension to the picked weft yarn which has reached the counter weft insertion side.

Besides, the weft traction device 23 is used to remove a mispicked weft yarn when the mispick has occured. The air ejection nozzle 21 is supplied with pressurized air through an electormagnetic valve 24 from the second air tank 18. The electromagnetic valve 24 is opened and closed in response to signals from the control unit 26. The weft suction pipe 22 is provided with a weft breakage sensor 25 which is adpated to sense entering of the broken weft yarn 5 into the weft suction pipe 22 thereby to detect a breakage of the picked weft yarn 5.

The solenoid for the measuring pawl 6, the weft unwinding sensor 7, the electromagnetic valves 11, 19, 24, the angle sensor 16, the feeler 20 and the breakage sensor 25 are electrically connected to the control unit 26 in order to carry out a control discussed after. Additionally, a control panel 27 is electrically connected to the control unit 26 so as to operate the air jet loom through the control unit 26. The control panel 27 is provided with a starting-preparation switch button **27*c* to make a starting-prepration (such as switching ON a power source) of the loom when pushed, a starting switch button 27*d* to start the loom to begin a weaving operation when pushed, an emergency stopping switch button 27*e* to stop the loom in an emergency when pushed, a normal rotation inching switch button 27*f* to start an inching operation under a normal (direction) rotation of the loom main shaft 15 when pushed, and a reverse rotation inching switch button 27*g* to start an inching operation under a reverse (direction) rotation of the loom main shaft 15 when pushed. The "inching operation" is defined as an operation to rotate the loom main shaft 15 at a speed lower than the speed during the normal weaving operatation in order to accomplish a gaiting operation to form an initial rough woven structure of a woven cloth: The, control panel 27 is further provided with a looming mode switch button 27*a* which activates an indicating lamp to indicate a looming operation when pushed, and a gaiting mode switch button 27*b*** for starting the gaiting operation when pushed.

The manner of operation of the air jet loom will be discussed hereinafter also with reference to FIGS. 2 to 5.

Figure 2:
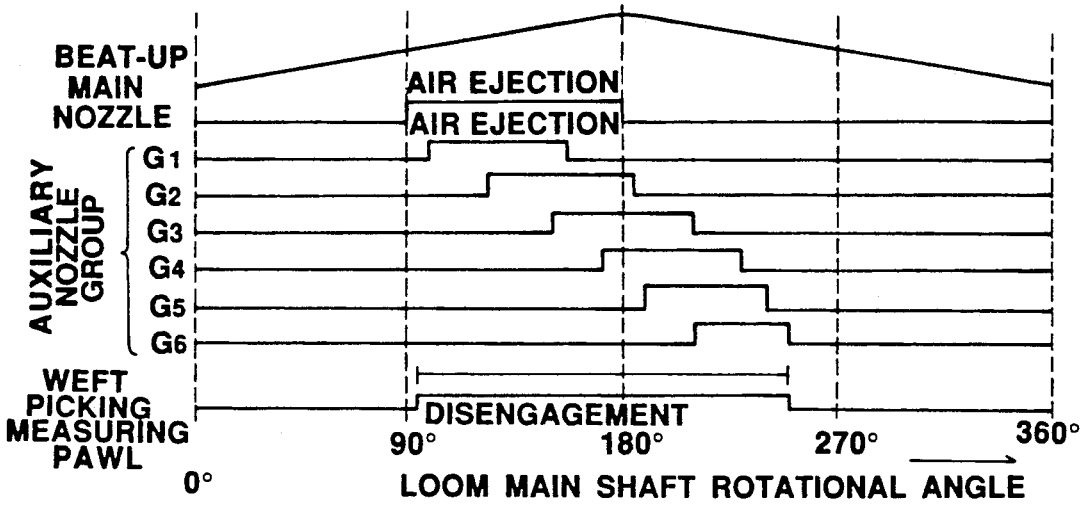
FIG. 2 is a timing chart showing an operational mode during a normal weaving operation of the loom of FIG. 1.

During a normal weaving operation, at an angle of 0 degrees of the loom main shaft 15, the reed blades 12 are located nearest to the cloth fell of a woven fabric (not shown), in which the measuring pawl 6 is brought into contact with the peripheral surface of the drum 3 to engage with the weft yarn 5. The loom main shaft 15 rotates at a speed of about 600 rpm, in which when the angle sensor 16 detects a predetermined loom main shaft angle (for example, 90 degrees in this embodiment), the electromagnetic valve 11 opens so that pressurized air is ejected from the main nozzle 9 while the measuring pawl 6, separates from the peripheral surface of the drum 3 to disengage the weft yarn 5 from the measuring pawl 6. As shown in FIG. 2, illustrating control timings of a normal weft picking, air ejection from the main nozzle 9 is accomplished during an angular width between loom main shaft rotational angles of 90 degrees and 180 degrees. Air ejection from the first group $G_1$ of the auxiliary nolzzes 17 (located the nearest the main nozzle 9) is accomplished during an angular width between the loom main shaft rotational angles of 100 degrees and 160 degrees. Air ejections from the second to sixth groups $G_2$ to $G_6$ of the auxiliary nozzles 17 are initiated respectively at timings which are later about 20 degrees (in the loom main shaft rotational angle) than the preceeding auxiliary nozzle group as clearly shown in FIG. 2. The time period of air ejection of the second and sixth groups of the auxiliary nozzles is between 60 degrees to 40 degrees in the loom main shaft rotational angle. The weft yarn 5 projected from the main nozzle 9 is carried through the weft guide channel under the influence of an air stream generated by air ejections from the first to sixth groups of the auxiliary nozzles $G_1$ to $G_6$. The thus carried weft yarn 5 flies to and reaches the counter weft insertion side at which the weft yarn 5 is detected by the feeler 20, thus completing a normal weft picking.

In such a weft picking, the weft unwinding sensor 7 is counting the winding number of the weft yarn 5, in which the measuring pawl 6 is again brought into contact with the peripheral surface of the drum 3 to engage with the weft yarn 5 when the predetermined length of the weft yarn 5 is unwound from the drum 3 to be projected from the main nozzle 9. The signals from the angular sensor 16 and the weft unwinding sensor 7 are input to the control unit 26, upon which the control unit 26 outputs signals to operate (open or close) the electromagnetic valves 11, 19, in response to the signals from the sensors 16, 7.

Figure 3:
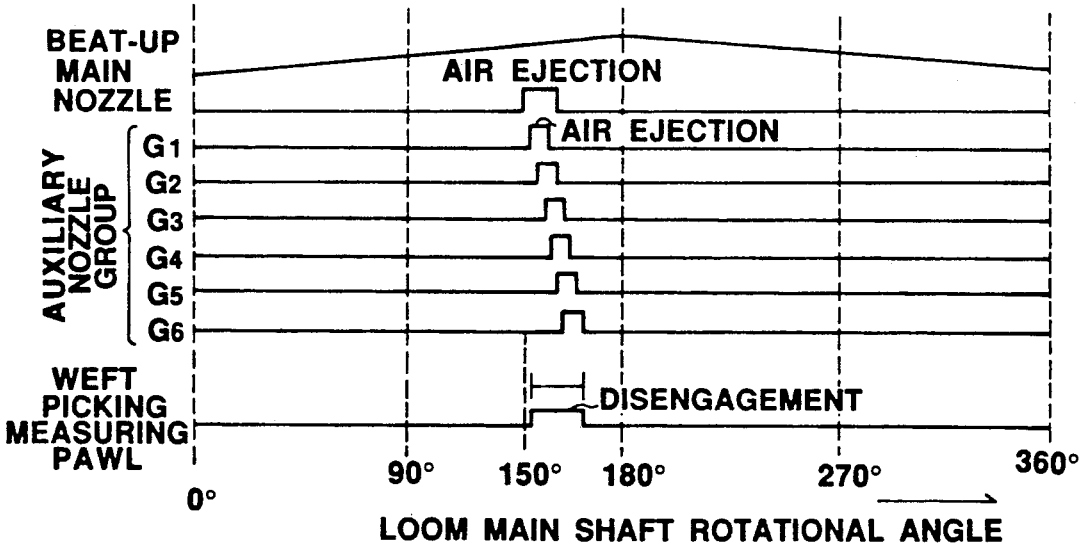
FIG. 3 is a timing chart showing another operational mode during a gaiting (inching) operation of the loom of FIG. 1.

During a gaiting operation carried out after a looming operation and before a normal weaving operation with the normal weft picking, when the normal rotation inching switch button **27*f* is pushed after the looming mode switch button 27*a* is pushed in the control panel 27, the loom main shaft 15 rotates in the normal direction at a low speed of about 30 rpm, in which the same control operations as those in the normal weaving opeartion are carried out. In this case, the rotational speed of the loom main shaft 15 is about 1/20 of that in the normal weaving operation; however, a weft picking is completed in the same time as that in the normal weaving operation. Accordingly, it is carried out to regulate the opening timings of the valves 11, 19 for the main nozzle 9 and the auxiliary nozzles 17 in timed relation to the low rotational speed of the loom main shaft 15. In this regard, according to this embodiment, the control unit 26 generates pseudo signals by which the angular width of opening the valves 11, 19 are set narrower than that in the normal weaving operation as shown in FIG. 3, in response to the signals from the angle sensor 16. Thus, during the gaiting operation, air ejection from the main nozzle 9 and the auxiliary nozzles 17** is carried out within an angular witdth of about 1/20 of that in the normal weaving operation.

More specifically, during the normal weaving operation, the loom main shaft 15 rotates at a high speed so that the main nozzle 9 and the auxiliary nozzles 17 are opened and closed to make their air ejection in time to the location of the leading end of the flying weft yarn 5 or at the (angular) timings shown in FIG. 2. In contrast, during the gaiting operation (inching operation), the loom main shaft 15 rotates at a low speed; however, the weft yarn 5 flies at the same speed as in the normal weaving operation. Accordingly, assuming that the valves 11, 19 are operated at the same timings as in the normal weaving operation in response to the signals from the angle sensor 16, only some groups of the auxiliary nozzles 17 will be able to eject air thereby causing a failed picking. In this regard, according to this embodiment, the control unit 26 does not generate the signals (in the normal weaving operation) for operating the valves 11, 19, directly in response to the signals from the angle sensor 16. In other words, when the angle sensor 16 generates a signal representing 150 degrees in loom main shaft rotational angle during the inching operation, a trigger is made to output a signal to the valve 11, in which the main nozzle 9 opens at 150 degrees as shown in FIG. 3. After the trigger is made, each of the valves 11, 19 are opened to eject air for the about same time width (period) as that in the normal weaving operation, in accordance with the pseudo signals which provide the same time width of opening the valve 11, 19 as that in the normal weaving operation and are derived on the basis of the corresponding singals in the normal weaving operation. By virtue of this, the weft yarn can fly through the weft guide channel to effectively accomplish a weft picking even during the gaiting or inching operation, without requiring any improvement to the electromagnetic valves 11, 19.

Thus, the control unit 26 generates the signals in response to the signals from the angle sensor 16 to cause the valves 11, 19 to open and close and the measuring pawl 6 to disengage from the weft yarn 5 on the drum 3 at the timings shown in FIG. 2 during the normal weaving operation, while generates the pseudo signals upon the trigger of the signal from the angle sensor 16 to cause the valves 11, 19 to open and close and the measuring pawl 6 to disengage from the weft yarn 5 at the timings shown in FIG. 3 during the gaiting or inching operation. It will be understood that engagement of the measuring pawl 6 with the weft yarn 5 is controlled in response to the signal from the weft unwinding sensor 7 and not in response to the singal from the angle sensor 16 both during the normal weaving operation and the gaiting operation.

A concrete explanation of operation of the control unit 26 will be made.

Figure 4A:
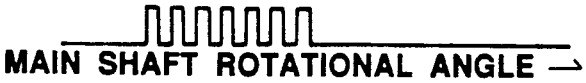
FIG. 4A is a wave form chart showing pulse signals in terms of loom main shaft rotational angle, to be used for control during the normal weaving operation.
Figure 5:
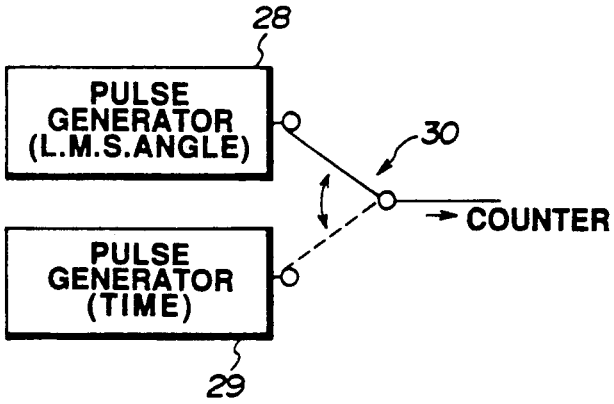
FIG. 5 is a diagram showing a principle of an essential part of control of the loom of the present invention.
Figure 6:
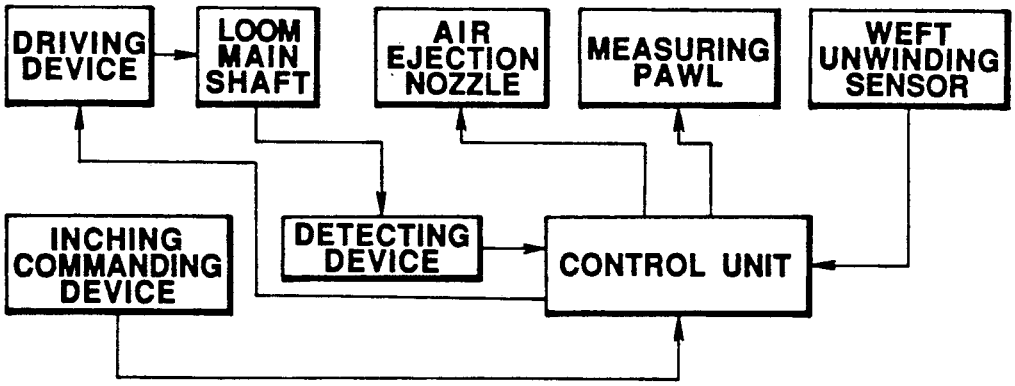
FIG. 6 is a block diagram illustrating the priciple of the present invention.

During the normal weaving operation, the angle sensor 16 generates intermittent signals at intervals of a predetermined loom main shaft angle when the main shaft 15 rotates from 0 degrees to 360 degrees in angle and outputs them to the control unit 26. As shown in FIG. 5, the control unit 26 includes a pulse generator 28 to generate pulse signals as shown in FIG. 4A, on the basis of the intermittent signals from the angle sensor 16. It will be understood that the pulse generator 28 is electrically connected with a counter (not identified) by means of a switch 30 as shown in FIG. 5, during the normal weaving operation. The number of the pulse (in FIG. 4A) is counted by the counter in the control unit 26 to determine the loom main shaft rotational angle or the timing shown in FIG. 2. At such a rotational angle or timing, a signal is output to the electromagnetic valve 11, 19 to cause it to open and close or to the solenoid to cause the measuring pawl 6 to disengage from the weft yarn 5 on the drum 3.

Figure 4B:
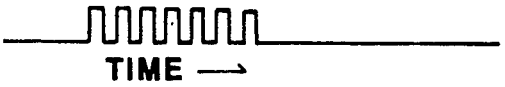
FIG. 4B is a wave form chart showing pulse signals in terms of time, to be used for control during the gaiting (inching) operation.
Figure 4C:
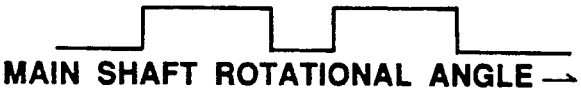
FIG. 4C is a wave form chart showing the same pluse signals of FIG. 4B but in terms of loom main shaft rotational angle.

When the normal rotation inching switch button 27*f* is pushed after the gaiting mode switch button 27*b* is pushed, the intermittent signals from the angle sensor 16 are supplied to the control unit 26 as same as during the normal weaving operation. At this time, the switch 30 is maintained in a state to establish the electrical connection between the counter and the pulse generator 28. However, when the loom main shaft rotational angle reaches 150 degrees, the switch 30 comes into a condition to establish an electrical connection between the counter with a pulse generator 29 which is in the control unit 26 and adapted to generate pseudo pulse signals as shown in FIG. 4B. The pseudo pulse signals are generated at intervals of a predetermined time, i.e., on the basis of time. The pulse width of each pseudo pulse signal is about the same as that of the pulse signal (shown in FIG. 4A) on the basis of the loom main shaft rotational angle. The pulse signals shown in FIG. 4A are produced on the basis of the rotational angle of the loom shaft during a normal weaving operation in which the loom shaft rotates at a high speed, whereas the pulse signals shown in FIG. 4B are produced on the basis of time during an inching or gaiting operation in which the loom main shaft rotates at a low speed. If however, the pulse widths of both pulse signals are the same as shown in FIGS. 4A and 4B under the noted different rotational speeds of the loom main shaft, the pulse width of the pulse signal (on the basis of time) of FIG. 4B (during the inching operation) is broadened as shown in FIG. 4C, in the sense of the rotational angle of the loom main shaft. The counter in the control circuit 26 counts the number of the pulse (in FIG. 4B) to determine the time lapse or timing as shown in FIG. 3. At such a timing, the pseudo signal is output to the electromagnetic valve 11, 19 to cause it to open and close or to the solenoid to cause the measuring pawl 6 to disengage from the weft yarn 5 on the drum 3. It is to be noted that the pseudo signal for operating the electromagnetic valve 11, 19 or the solenoid for the measuring pawl 6 is generated at the same count number of the pulses as that during the normal weaving operation. As a result, although the loom main shaft 15 rotates at a low speed, the main nozzle 9 and the plural auxiliary nozzles 17 can eject air at such suitable timings that the weft yarn 5 stably flies through the weft guide channel thereby accomplising a weft picking during the gaiting operation. Then, the weft unwinding sensor 7 detects unwinding of the weft yarn 5 from the drum 3. When the winding number of the weft yarn 5 unwound reaches a predetermined value, the solenoid is operated to cause the measuring pawl 6 to come into contact with the peripheral surface of the drum 3 so as to engage with the weft yarn 5 on the drum 3. In this embodiment, an operation including a normal rotation inching and a weft picking is continuously repeated when an operator continues to pushing the normal rotation inching switch button 27*f* after pushing the gaiting mode switch button 27*b*. In this connection, it may be possible to make such a setting that the operation including a normal rotation inching and a weft picking is repeated several times only by pusing the normal rotation inching switch one time after pushing the gaiting mode switch button 27*b*.

As apparent from the above, according to this embodiment, when the inching operation is carried out during the gaiting operation, the weft picking in the apparently same manner as during the normal weaving operation is carried out, so that the weft yarn 5 can fly through the weft guide channel under the influence of air stream generated by air jets ejected at suitable timings from the main nozzle 9 and the auxiliary nozzles 17 thereby effectively accomplishing a weft picking during the gaiting operation. While this embodiment has been described and shown as being arranged to initiate to generate the pseudo signals for operating the electromagnetic valves 11, 19 and the solenoid for the measuring pawl 6, at a timing of 150 degrees in loom main shaft rotational angle, it will be appreciated that generation of the same pseudo signals may be initiated at any timing (for example, 90 degrees in loom main shaft rotational angle) during a time period in which a weft picking is possible or in which a shed (between the upper and lower warp yarn arrays) is formed. It will be understood that the pulse generator 29 for generating the pseudo pulse signals may not be used, in which a timer is provided and arranged to operate the electromagnetic valves 11, 19 and the solenoid for the measuring pawl 6 at suitable timings shown in FIG. 3 under a trigger of the signal representing a loom main shaft rotational angle (such as 150 degrees). As discussed above, measuring a length of the weft yarn 5 required for one pick is made under the action of the weft unwinding sensor 7, and therefore an acurate measuring can be achieved.

While only an air jet loom has been shown and described, it will be understood that the priciple of the present invention may be applied to a water jet loom in which water jet is ejected from a main or weft inserting nozzle. It will be appreciated that an electric motor for the inching operation may be provided separate from the electric motor for the normal weaving operation.

What is claimed is:

1. A fluid jet loom comprising:

at least one fluid ejection nozzle for inserting a weft yarn to accomplish a weft picking when ejecting fluid;

a weft measuring and storing device for storing the weft yarn prior to the weft picking, said device including a measuring pawl which is disengageable from the weft yarn to allow the weft yarn to be released to be inserted and engageable with the weft yarn to stop releasing of the weft yarn;

driving means for rotating a loom main shaft at a first speed during a normal weaving operation and at a second speed lower than the first speed upon receiving a first signal;

inching commanding means for generating the first signal to command an inching operation;

means for detecting a rotational angle of said loom main shaft and generating a second signal representing the rotational angle when said loom main shaft is rotating at the second speed; and first control means for causing said fluid ejection nozzle to eject fluid for a predetermined time and causing said measuring pawl to disengage from and engage with the weft yarn to allow a predetermined length of the weft yarn to be released, when or after said second signal represents a first predetermined loom main shaft rotational angle.

2. A fluid jet loom as claimed in claim 1, further comprising means for detecting the rotational angle of said loom main shaft and generating third signals representing the rotational angles when said loom main shaft is rotating at the first speed.

3. A fluid jet loom as claimed in claim 2, wherein said third signal provided by the detecting means and representing the rotational angle when the loom shaft is at the first speed is the same as said second signal representing the rotational angle when the loom shaft is rotated at the second speed.

4. A fluid jet loom as claimed in claim 2, further comprising second control means for causing said fluid ejection nozzle to eject fluid during a predetermined loom main shaft rotational angle width and causing said measuring pawl to disengage from and engage with the weft yarn to allow a predetermined length of the weft yarn to be released, in response to the third signals.

5. A fluid jet loom as claimed in claim 4, wherein a loom main shaft rotational angle width corresponding to said predetermined time is smaller than said predetermined loom main shaft rotational angle width.

6. A fluid jet loom as claimed in claim 1, wherein said first control means includes means for generating a first base signal at predetermined intervals of time, in which said fluid ejection nozzle ejects air in accordance with said first base signal.

7. A fluid jet loom as claimed in claim 6, wherein said second control means includes means for generating a second base signal in accordance with the loom main shaft rotational angle, in which said air ejection nozzle ejects air in accordance with said second base signal.

8. A fluid jet loom as claimed in claim 6, wherein said means for generating said first base signal comprises means for generating first pulse signals at predetermined intervals of time.

9. A fluid jet loom as claimed in claim 7, wherein said second base signal produced by said second control means comprises second pulse signals generated at predetermined intervals of time.

10. A fluid jet loom as claimed in claim 9, further comprising means for controlling said first and second pulse signals such that each of said first pulse signals and each of each of said second pulse signals have the generally same pulse width.

11. A fluid jet loom as claimed in claim 7, further comprising a valve through which air under pressure is supplied to said fluid ejection nozzle, said valve including means to open to allow said fluid ejection nozzle to eject air and to close to stop air ejection from said fluid ejection nozzle.

12. A fluid jet loom as claimed in claim 11, wherein said first control means includes means for generating a fourth signal at a first timing to open said valve, and a fifth signal at a second timing to close said valve, said first and second timings defining therebetween said predetermined time, said first and second timings being determined in accordance with said first base signal.

13. A fluid jet loom as claimed in claim 12, wherein said second control means includes means for generating a sixth signal at a third timing to open said valve, and a seventh signal at a fourth timing to close said valve, said third and fourth timings defining therebetween a predetermined loom rotational angle width, said second and third timings being determined in accordance with said second base signal.

14. A fluid jet loom as claimed in claim 13, wherein said first control means includes means for generating an eighth signal at a fifth timing to disengage the weft yarn from said measuring pawl, said fifth timing being determined in accordance with said first base signal.

15. A fluid jet loom as claimed in claim 14, further comprising means for detecting releasing of the predetermined length of the weft yarn and generating a ninth signal at a sixth timing, said predetermined length of the weft yarn being released between said fifth timing and said sixth timing.

16. A fluid jet loom as claimed in claim 15, wherein said second control means includes means for generating an tenth signal at a seventh timing to disengage the weft yarn from said measuring pawl, said seventh timing being determined in accordance with said second base signal.

17. A fluid jet loom as claimed in claim 16, further comprising means for detecting releasing of the predetermined length of the weft yarn and generating an eleventh signal at an eighth timing, said predetermined length of the weft yarn being released between said seventh and eighth timings.

18. A fluid jet loom as claimed in claim 1, wherein said weft measuring and storing device includes a weft suporting structural member on which the weft yarn is wound, said measuring pawl including means for being projectable toward said structural member to engage with the weft yarn and withdrawable from said structural member to disengage from the weft yarn.

19. A fluid jet loom as claimed in claim 1, wherein said at least one fluid jet nozzle includes a main nozzle through which the weft yarn passes, the weft yarn being projected from said main nozzle under influence of fluid ejected from said main nozzle, and a plurality of auxiliary nozzles for ejecting fluid to assist insertion of the weft yarn.

20. A fluid jet loom as claimed in claim 19, wherein said main nozzle and said auxiliary nozzles include means to eject fluid under pressure.

* * * * *

UNITED STATES PATENT AND TRADEMARK OFFICE

CERTIFICATE OF CORRECTION

PATENT NO. : 5,127,445

DATED : July 7, 1992

INVENTOR(S) : Norio Kakehashi

It is certified that error appears in the above-identified patent and that said Letters Patent is hereby corrected as shown below:

On the title page: Item

[30] Foreign Application Priority Data

Oct. 4, 1989 [JP] Japan .....1-116684

Signed and Sealed this

Third Day of August, 1993

*Attest:*

*Attesting Officer*

Michael K. Kirk

MICHAEL K. KIRK

*Acting Commissioner of Patents and Trademarks*